US005778465A

United States Patent [19]

Myers

[11] Patent Number: 5,778,465

[45] Date of Patent: Jul. 14, 1998

[54] BASSINET FOR ATTACHMENT TO A CHILD'S PLAYARD

[75] Inventor: Peter Jonathan Myers, Wheaton, Ill.

[73] Assignee: Kolcraft Enterprises, Inc., Chicago, Ill.

[21] Appl. No.: 741,376

[22] Filed: Oct. 30, 1996

[51] Int. Cl.[6] ..... A47D 7/00

[52] U.S. Cl. ..... 5/99.1; 5/93.2; 5/93.1

[58] Field of Search ..... 5/93.1, 93.2, 95, 5/98.1, 98.3, 99.1, 94

[56] References Cited

U.S. PATENT DOCUMENTS

| | | | |
|---|---|---|---|
| 961,669 | 6/1910 | Atkinson . | |
| 1,204,416 | 11/1916 | Doser . | |
| 2,553,087 | 5/1951 | Hanson | 5/93 |
| 2,688,997 | 9/1954 | Miller | 155/44 |
| 3,078,478 | 2/1963 | Sheahan | 5/93 |
| 3,574,872 | 4/1971 | Mattila | 5/94 |
| 3,644,947 | 2/1972 | Padera | 5/92 |
| 3,735,430 | 5/1973 | Platz | 5/93.1 X |
| 4,073,017 | 2/1978 | Stevens | 5/97 |
| 4,750,223 | 6/1988 | D'Arcy et al. | 5/99 B |
| 4,967,432 | 11/1990 | Kujawski et al. | 5/98.1 |
| 4,999,863 | 3/1991 | Kane | 5/99.1 X |
| 5,115,524 | 5/1992 | Antosko | 5/99.1 |
| 5,339,470 | 8/1994 | Shamil | 5/93.2 X |
| 5,349,709 | 9/1994 | Cheng | 5/93.1 |
| 5,535,457 | 7/1996 | Welsh, Jr. et al. | 5/93.1 |
| 5,553,336 | 9/1996 | Mariol | 5/95 X |
| 5,555,577 | 9/1996 | Volpe | 5/95 |
| 5,615,427 | 4/1997 | Huang | 5/98.1 X |

OTHER PUBLICATIONS

"EVENFLO" Play Yard with Bassinet Attached.
"GRACO" Play Yard with Bassinet Attached.

*Primary Examiner*—Michael F. Trettal
*Attorney, Agent, or Firm*—Marshall, O'Toole, Gerstein, Murray & Borun

[57] ABSTRACT

A bassinet for an infant having a foldable floor and flexible side walls that are suspended above a playard floor with extruded plastic hooks engaged to the playard for a safe and secure connection. The hooks are shaped to easily be installed and removed for quick change over from bassinet to playard and back again. The bassinet is easily installed and removed by one person and, due to its construction, may be folded with the playard for convenient storage.

24 Claims, 4 Drawing Sheets

BASSINET FOR ATTACHMENT TO A CHILD'S PLAYARD

FIELD AND BACKGROUND OF THE INVENTION

This invention relates generally to a bassinet for an infant that can be installed in a playard, and more particularly to a bassinet having a foldable floor and flexible side walls that are suspended above the playard floor with substantially rigid hooks engaged to the playard for a safe and secure connection. The hooks are configured to be installed and removed easily whereby the bassinet can be placed on or removed from a playard. The construction of the bassinet makes it possible for one person to either install or remove the bassinet and fold it together with the playard for convenient storage.

Playards are small play areas for young children and generally include side walls and a bottom floor which serve as an enclosure for a child. It is known to enhance the usefulness of a playard by installing a bassinet therein. For example, U.S. Pat. No. 4,967,432 shows a playard which can be converted to a bassinet by installing sleeves over the entire perimeter of the playard. Concealed side hooks are used to enhance stability of the bassinet, but such a sleeved construction with a rigid bassinet floor is difficult and time consuming to install. Further, because the hooks are concealed beneath fabric they are somewhat difficult to manipulate and disengage from the top rail.

U.S. Pat. No. 2,553,087 discloses a bassinet having a rigid frame and includes hooks joined to its floor for engaging a top rail of a playard to suspend the bassinet at a convenient elevation relative to the top rail. The hooks serve to provide stability for a bassinet, however, it does not appear this system would be effectual with a frameless and foldable bassinet.

U.S. Pat. No. 3,574,872 discloses an infant car bed having metal pad members that wedge the bed between front and back car seats. The mechanism used to create the wedging force appears complicated and of questionable stability should it be used in combination with a playard.

U.S. Pat. No. 1,204,416 discloses a baby hammock for use in an automobile. The hammock has a suspension device at each of its four corners for securing the hammock to an automobile chassis. To prevent the hammock from flipping, a strap is secured to both the automobile floor and to the bottom of the hammock. This hammock restrains a baby in a single sleeping position unlike a rigid and flat sleeping surface.

U.S. Pat. No. 3,078,478 discloses a tray for use in a crib. The tray is suspended by straps above the bottom of the crib. The straps are secured to the crib with buckles. These trays are relatively time consuming to install and the tray would interfere with the installation of any bassinet. There is no provision for using the tray with any bassinet on a playard.

What is desired is a bassinet for use with a playard wherein the bassinet is relatively stable and includes a frame which is not rigid but, preferably, rather, the frame may be foldable with the playard for storage or other purposes. Additionally it also is desirable to have a bassinet that is easy to install with a secure connection. Finally, it also is desirable to have a bassinet which includes a tray conveniently located for storing baby supplies or other items.

SUMMARY OF THE INVENTION

The present invention serves to achieve the aforementioned desires. Briefly, the bassinet disclosed and claimed herein is convenient to install, remove, and store with a playard. The bassinet provides an enclosed flat rigid area adapted to hold an infant without the need of a separate rigid frame. The bassinet is foldable and readily attachable to a top rail of a playard. It includes a flexible fabric bottom, upwardly extending side walls attached to the bottom, a first substantially rigid panel adapted to be disposed on the flexible fabric bottom and having an edge, a second substantially rigid panel also adapted to rest on the flexible fabric bottom and having an edge adjacent said panel edges to define a fold line therebetween; a frameless and sleeveless upper edge defining an upper perimeter of the foldable bassinet; and a plurality of hooks attached to the frameless and sleeveless seam on opposite sides of the fold line, each for releasably engaging the top rail of the playard.

The foldable bassinet may further include a first flexible pad bearing on the first rigid panel, and having an edge substantially vertically aligned with the fold line; and a second flexible sleeper pad bearing on the second rigid panel and having an edge substantially vertically aligned with the fold line.

Corner hooks may be used for added stability. Further, the hooks may include outwardly extending finger release tabs. The bassinet may include an accessory tray defining a receptacle. The bassinet may include a playard which can be folded with the bassinet for storage.

DETAILED DESCRIPTION OF THE DRAWING

Figure 1:
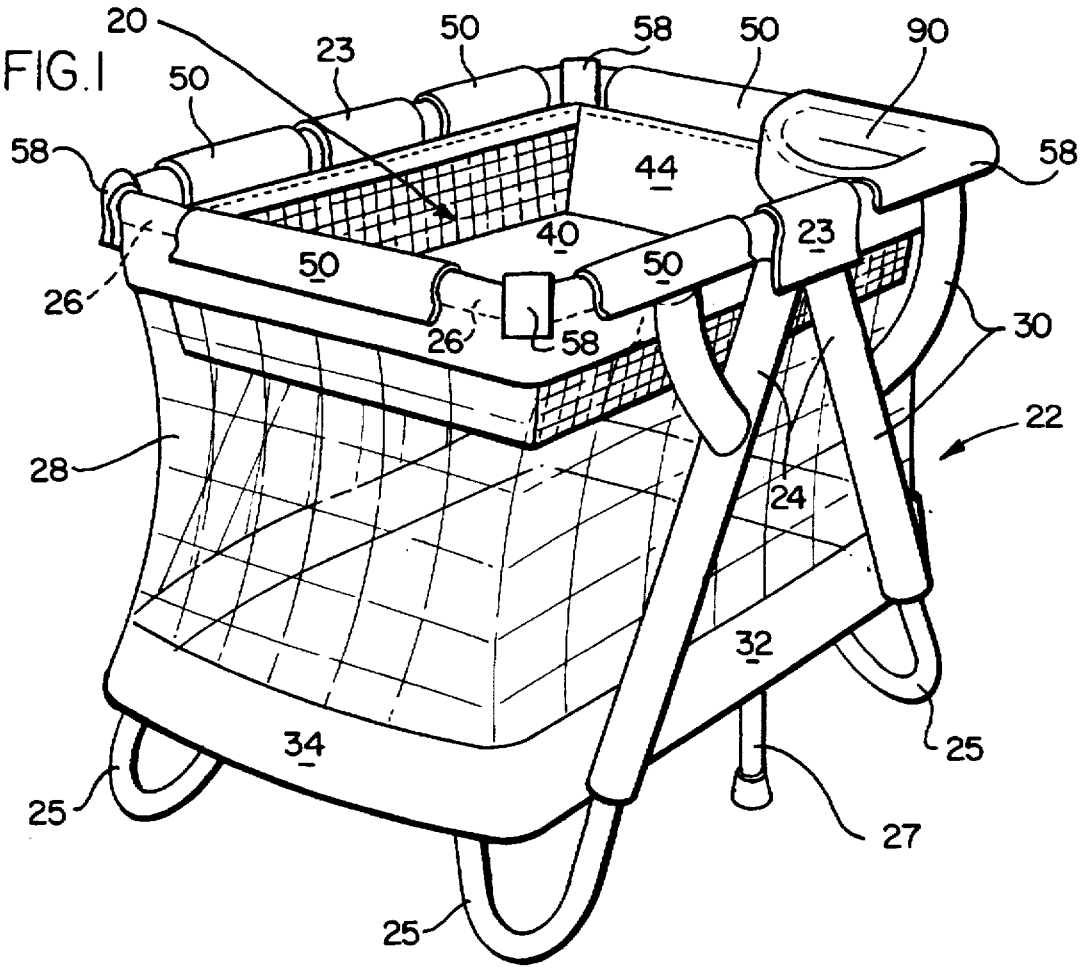
FIG. 1 shows a perspective view of a bassinet in accordance with the present invention installed in a playard.

To the extent reasonable and practical, the same reference numerals will be used in each of the figures described below. Depicted generally in FIG. 1 is bassinet 20 in accordance with the present invention for attachment to playard 22.

Figure 7:
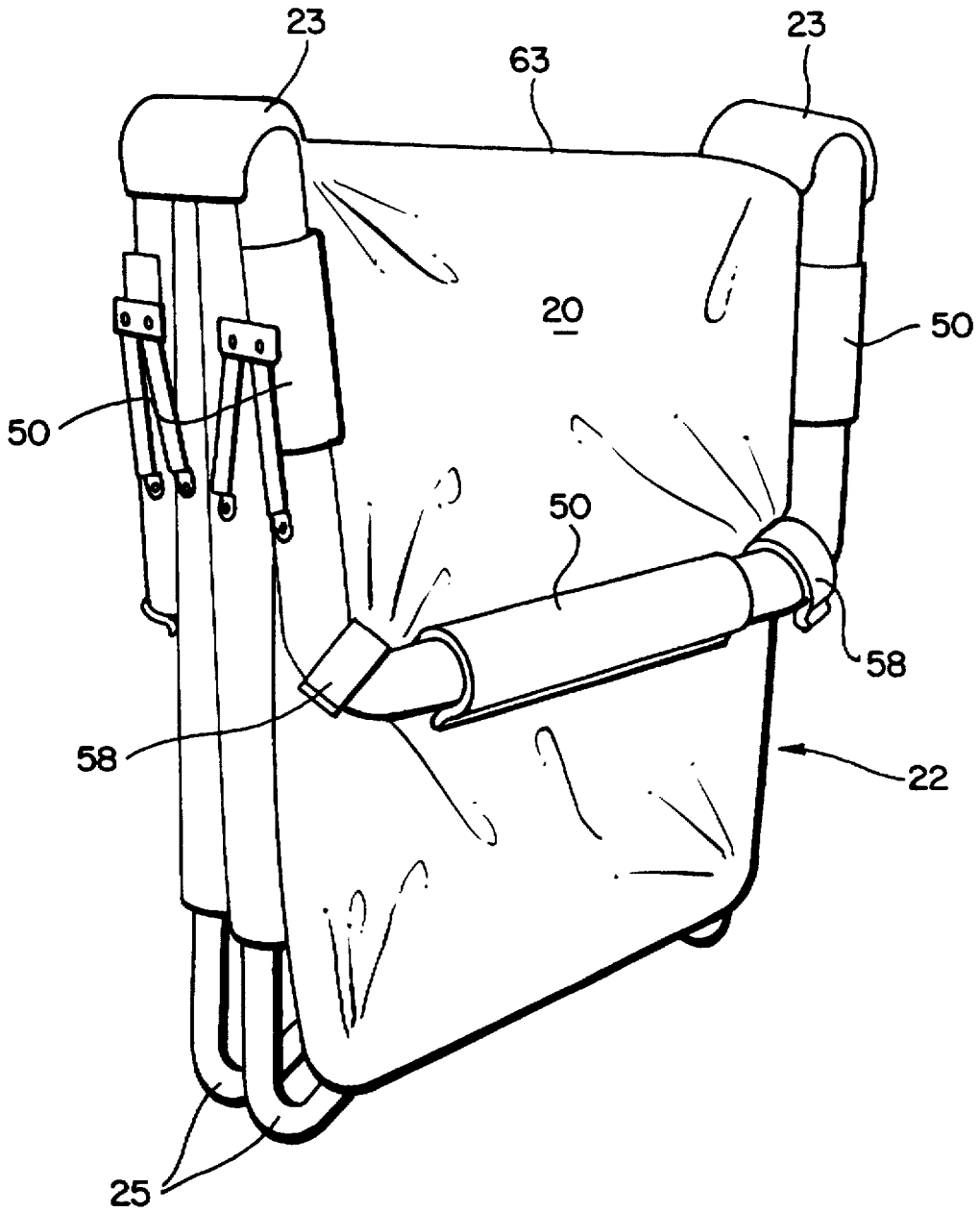

Playard 22 includes a rigid and foldable metal frame 24 having inverted V-shaped legs 25, center strut legs 27, and top rail 26 which is disposed about the upper perimeter of the frame. Playard 22 also includes mesh side walls 28 and bottom 29 disposed within the side walls. Foam padding 30 is disposed on various metal parts normally exposed to a child. Playard 22 is adapted to fold at a hinge concealed under fabric overlays 23 whereby legs 25 and top rail 26 collapse whereby playard 22 is adapted to be folded as depicted in FIG. 7 for storage purposes.

Bassinet 20 is sized to roughly match the dimensions of playard 22 in the assembled position of FIG. 1. Bassinet 20 includes bottom 40, two side walls 42 extending along one playard length and two side walls 44 extending across the playard width. The length of the bassinet is substantially greater than its width and is of an approximate length and width of the top perimeter of a playard. Other shapes of bassinets are possible which match the shape of the playard into which the bassinet will be inserted. The side walls preferably taper inward slightly from top edge 48 to a bottom edge attached to bottom 40. Although illustrated with four separate side walls, bassinet 20 may be constructed with any number of side walls including one continuous side wall which is attached to and extends about the periphery of bottom 40. Other embodiments may have side walls that only partially surround bottom 40. Further, as used herein the term "edge" includes the entire seam or other connection where adjacent side walls and/or bassinet bottom are joined together.

A plurality of spaced, substantially rigid hooks 50 are attached to side walls 42 and 44, adjacent the top edge 48 of the side walls. Hooks 50 may be sewn to side walls 42 and 44 or attached by other suitable means. The hooks are purposely spaced to permit folding of the playard as discussed hereafter. Further, the playard is free of any fabric sleeve which must be slipped over the playard rail. The entire function of securing bassinet 20 to playard 22 is, therefore, performed by spaced hooks 50 (and hooks 58 discussed below).

Figure 2:
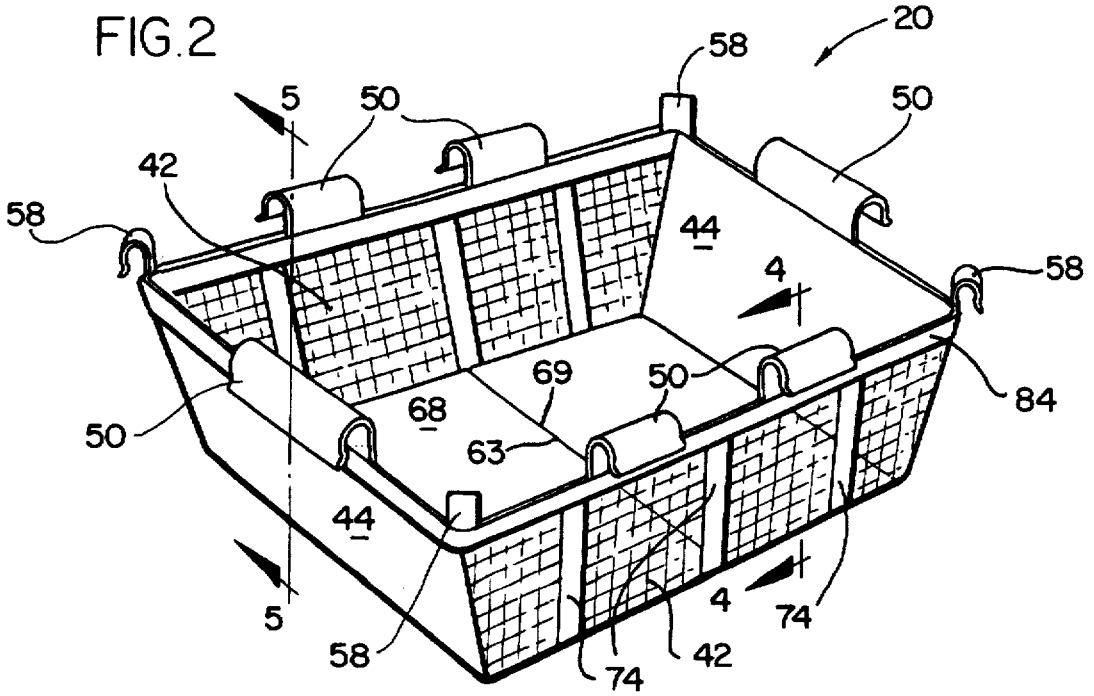
FIG. 2 shows a perspective view of the bassinet of FIG. 1 removed from the playard.

Referring to FIG. 2, it can be seen that side walls 42 of bassinet 20 are made of a fabric mesh to provide cross-ventilation and improved visibility into bassinet 20. Side walls 44 of bassinet 20 preferably are fabricated from a nylon fabric formed from of a continuous sheet which extends from the top edge of one side wall 44 along the length of bassinet bottom 40, and terminates at the top edge of the opposite side wall 44. A single sheet of fabric used from end-to-end in this manner serves to provide a strong and safe bassinet 20. The mesh side walls 42 are sewn along their respective edges to the corresponding edges of the nylon sheet that forms bottom 40 and side walls 44.

Hooks 50 are each configured to define arcuate recess 52 into which top rail 26 of playard 22 is received. Hooks 50 are substantially rigid members preferably made of an extruded molded plastic which can be polypropylene, polyethylene, or other material suitable to provide a smooth and non-toxic surface. The hooks include a resilient snap-on type member having a finger release tab 54. When the bassinet is installed on a playard, the fingers extend outwardly from the bassinet 20 so that they are readily available, as shown in FIG. 1, to an individual desirous of removing the bassinet from the playard by lifting up tab 54 and removing a hook 50 from top rail 26 of playard 22. Finger release tabs 54 assist in the installation of the hooks 50 inasmuch as they guide top rail 26 into the arcuate recesses 52 of hooks 50.

In addition, bassinet 20 incorporates a hook 58 located at each bassinet corner. Hook 58 also is adapted to engage top rail 26. Absent the corner hooks 58, the corners of bassinet bottom 40 tend to sag downward providing a less stable surface. With the arrangement of the present invention, continuous nylon sheet 46 in combination with the four corner hooks 58 serve to provide the desired stability of an assembled bassinet 20 without the need of a rigid frame or sleeve member as found in the prior art.

Figure 3:
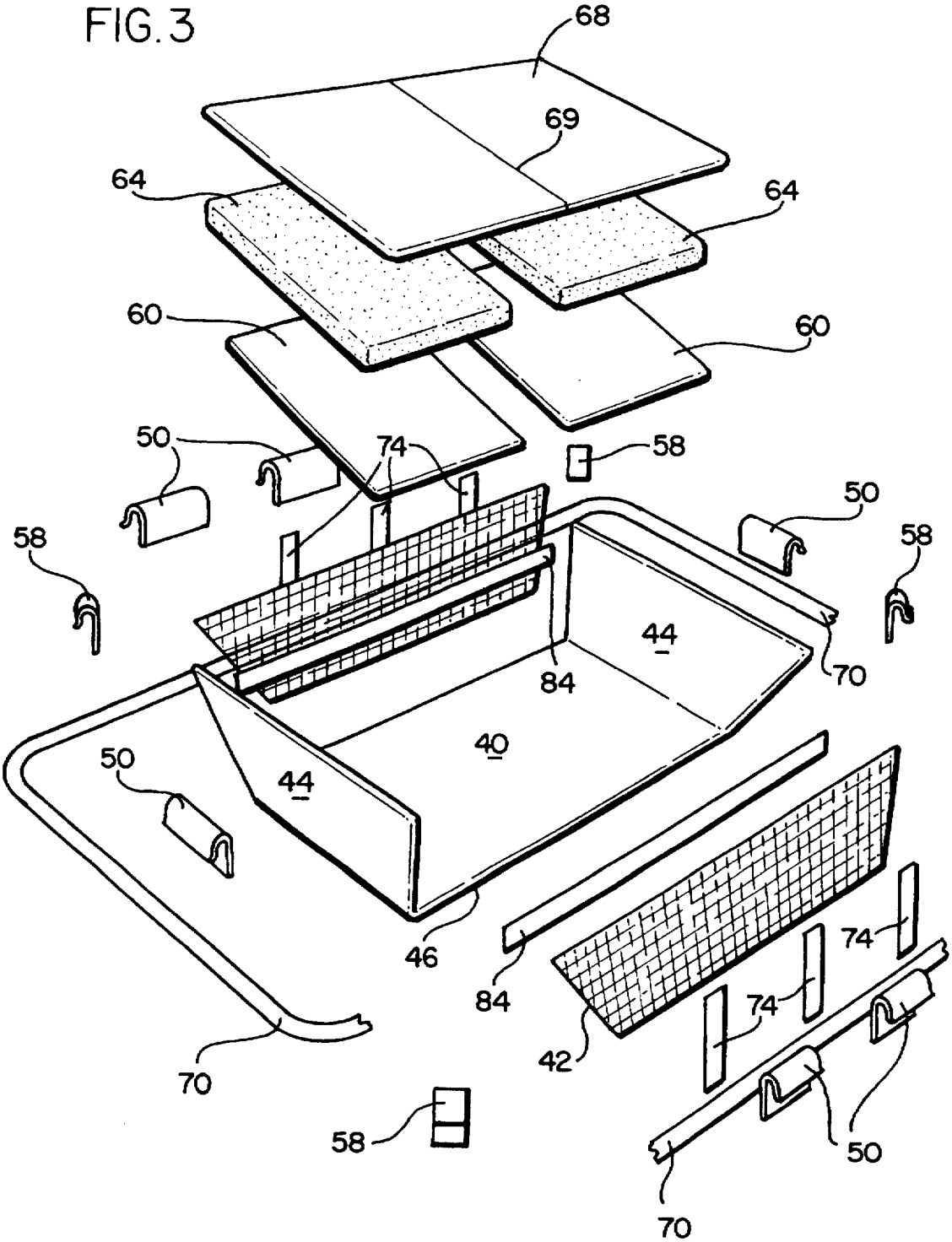
FIG. 3 shows an exploded view of the bassinet of FIGS. 1 and 2.

Referring to FIG. 3, nylon sheet 46 is illustrated as being continuous from one side wall 44 through bottom 40 to the remaining side wall 44. Adapted to be positioned on the top surface of nylon sheet 46 at the location of bassinet bottom 40 are two substantially rigid bottom panels 60 preferably made of hardboard. Each bottom panel 60 is substantially rectangular in shape and is adapted to lay edge-to-edge in bottom 40 of bassinet 20 to define a fold line 63 about which the entire bassinet 20 can be folded for transport and storage either alone or in combination with the playard 22 as seen in FIG. 7. Panels 60 are separate from one another as illustrated; however, if desired, panels 60 could be assembled having one or more hinges to provide structural continuity. Further, other shapes of panels 60 may be used to match the shape of a portion of bottom 40.

On top of bottom panels 60 are two conventional foam pads 64, each pad 64 corresponding in size to one of bottom panels 60. Preferably, pads 64 are made of approximately ½" thick urethane foam. On top of the foam pads 64 is positioned a flexible nylon top sheet 68 that provides a relatively flexible surface upon which an infant can be placed. Flexible nylon top 68 is preferably made of two separate sheets of material sewn together at seam 69.

With the bassinet arrangement of the present invention, bottom 40 of bassinet 20 is adapted to be folded in half whereby bottom panels 60 and pads 64 meet edge-to-edge at fold line 63 without the need to remove pads 64 or flexible nylon top 68. Bassinet 20 is collapsible inasmuch as side walls 42 and 44 of bassinet 20 are frameless and are adapted to fold and collapse to permit bassinet bottom 40 to assume the position shown, for example, in FIG. 6 when bassinet 20 is not attached entirely to playard 22. Further, as illustrated in FIG. 7, because of the configuration of bassinet 20, the playard 22 can be folded and stored without removing bassinet 20 which folds and collapses with the playard along fold line 63. This arrangement serves to save time and effort when the entire playard 22 is to be set up or collapsed and stored.

As shown in FIGS. 2 to 5, a reinforcing band of nylon webbing 70 is sewn along and adjacent top edge 48 of nylon sheet 46 and fabric mesh side walls 42, the web band extending around the entire perimeter of bassinet 20. Horizontal webbing 70 is integrated with bottom 40 by means of nylon support straps 74 which extend vertically along mesh side walls 42 and bottom 40, as seen in FIG. 2. Straps 74 are sewn to horizontal webbing 70 at their upper ends and to nylon bottom 40 at their bottom ends. The spaced vertical support straps 74 also provide resistance to sagging along the middle of bassinet 20. For further reinforcement on the mesh side walls 42, an additional horizontal fabric strip 84, preferably made of nylon, is sewn along the length of the inside surface of side walls 42 and horizontal webbing 70. In the illustrated embodiment, no such web is necessary on side walls 44 which is formed from nylon sheet 46.

Figure 4:
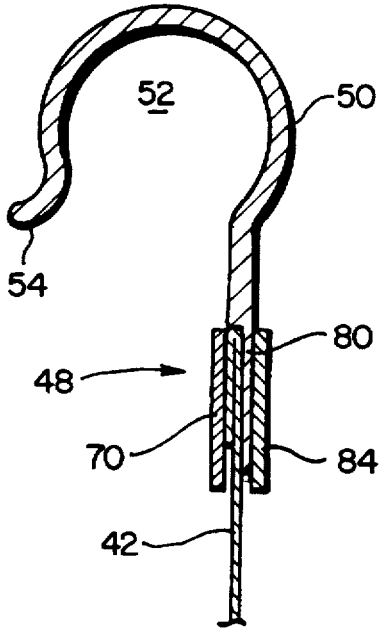
FIG. 4 shows a cross-sectional view of a hook connection taken along lines 4—4 in FIG. 2.
Figure 5:
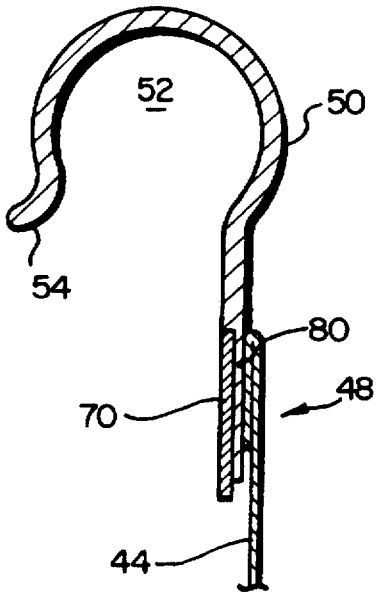
FIG. 5 shows a cross-sectional view of a hook connection taken along lines 5—5 in FIG. 2.

FIG. 4 illustrates a connection between a hook 50 and top edge 48 (or seam) of a fabric side wall 42. Hook 50 includes an arcuate recess 52 as described above together with a finger release tab 54. At the lower end of hook 50 the extruded plastic is reduced in cross-sectional thickness at a hook sewing section 80. Fabric mesh side walls 42 include a single fold 90 for reinforcement and resistance to fraying. Each side wall 42 is positioned adjacent hook sewing surface 80 and is sandwiched between webbing 70 and nylon reinforcing strip 84. The materials are sewn together in a single operation using any suitable industrial strength thread. FIG. 5 illustrates a hook 50 sewn to a top edge 48 of a side panel 44. The connection is similar to that illustrated in FIG. 4, except that no reinforcing strip 84 is utilized and hook sewing surface 80 is sandwiched between side wall 48 and webbing 70. Corner hooks 58 are sewn to bassinet 20 in a similar manner.

As a result of the construction of bassinet 20 in accordance with the present invention, the bassinet is relatively light weight and foldable for storage purposes. It also is relatively easy to assemble to or remove from a playard by utilization of extruded plastic hooks 50 and 58.

Figure 6:
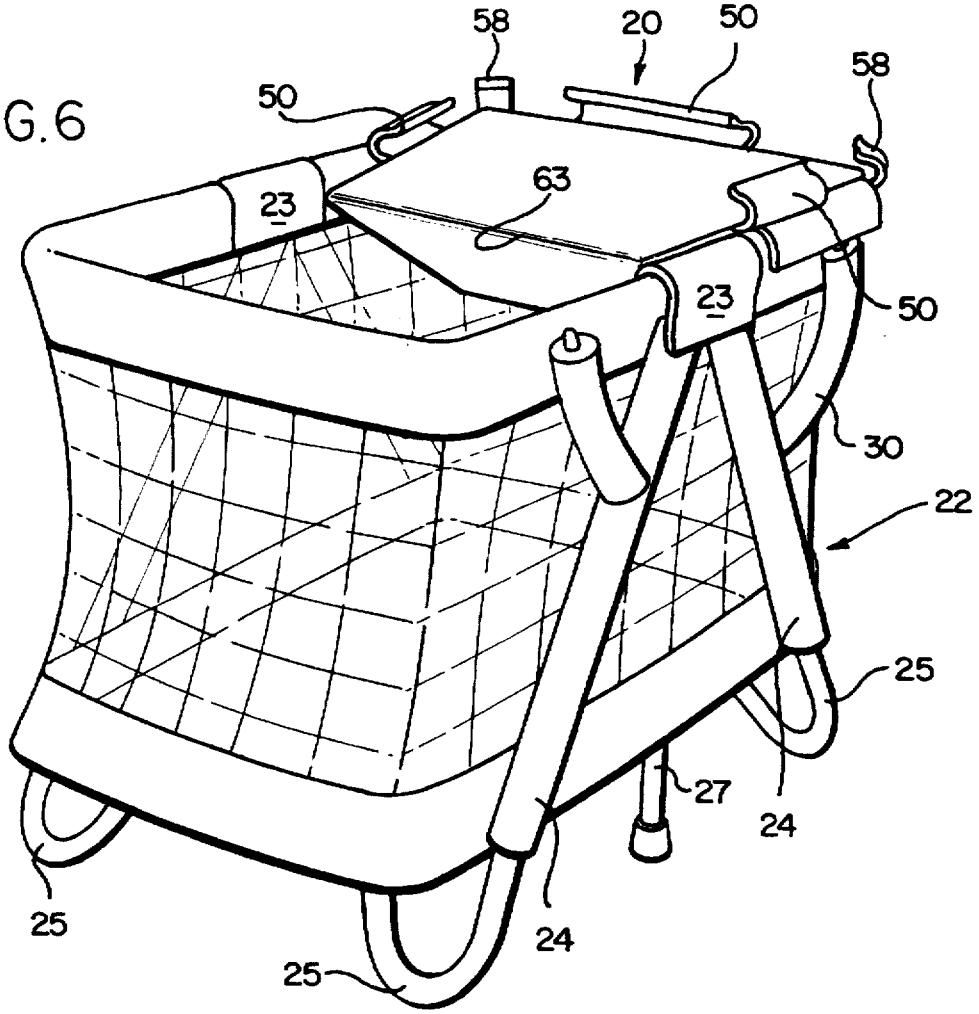
FIG. 6 shows a perspective view of a bassinet partially installed on a playard; and, FIG. 7 shows a perspective view of a bassinet and a playard folded together for storage.

To install bassinet 20 onto playard 22, hooks 50 and 58 on one half of bassinet 20 are engaged with top rail 26 of playard 22 while the remaining half of the bassinet 20 remains in the folded over position illustrated in FIG. 6. After hooks 50 and 58 are connected on one side of bassinet 20, hooks 50 and 58 on the remaining side of bassinet 20 are fastened to playard rail 26 simply by unfolding the bassinet and pushing hooks 50 and 58 down on top rail 26. Finger tab 54 also provides a convenient means for guiding arcuate recess 52 of hooks 50 and 58 into top rail 26.

To remove bassinet 20 from playard 22, finger release tabs 54 on hooks 50 and 58 are pulled upward to disengage hooks 50 and 58 from top rail 26 of the playard frame 24. As hooks 50 and 58 are removed, bassinet 20 can be folded over at the fold line 63 between bottom panels 60 and pads 64 onto itself. Hooks 50 and 58 on the opposite side then can be removed and bassinet 20 lifted out of playard 22 for storage. This construction procedure allows one person to install bassinet 20 relatively easily without stretching uncomfortably or reaching unsafely across bassinet 20.

In addition to the improvements described above, bassinet 20 also can be provided with a modified corner hook 58 and corner tray 90 as depicted in FIGS. 1 and 5. Corner tray 90 is preferably molded integrally with corner hook 58, or it can be molded integrally with an L-shaped hook as depicted in FIG. 5. Alternatively, corner tray 90 can be molded integrally with two separate hooks 50 positioned adjacent to the corner of playard 22.

The above detailed description is provided for clearness of understanding only, and no unnecessary limitations therefrom should be read into the following claims.

I claim:

1. A foldable bassinet for releasable attachment to a top rail of a play yard, said bassinet comprising:

a collapsible bottom having a length and width, and is collapsible along a fold line;

a first pair of flexible side walls each side wall having top and bottom edges and each side wall bottom edge of the first pair being attached to said bottom along the bottom width;

a second pair of flexible side walls each side wall having top and bottom edges and each side wall bottom edge of the second pair being attached to said bottom along the length of said bottom;

the bottom and the first and second pairs of side walls being formed of a flexible material and forming a pocket for receipt of an infant, the pocket being foldable; and, a plurality of spaced, substantially rigid hooks attached to the top edges of each of the first and second pairs of side walls to form a frameless, foldable bassinet with said hooks being adapted to connect to a top rail of a play yard.

2. The foldable bassinet of claim 1 in which the bottom comprises:

a first rigid bottom panel having an edge; and a second rigid bottom panel having an edge adjacent to the first bottom panel edge to define the fold line along which the bassinet bottom is collapsible.

3. The foldable bassinet of claim 2, and further comprising:

a first flexible sleeper pad bearing on the first rigid panel, and having an edge substantially vertically aligned with the fold line; and a second flexible sleeper pad bearing on the second rigid panel and having an edge substantially vertically aligned with the fold line.

4. The foldable bassinet of claim 3, and further comprising:

a flexible fabric top layer secured over the first and second sleeper pads.

5. The foldable bassinet of claim 1, and further comprising:

a tray attached to the bassinet.

6. The foldable bassinet of claim 1, and further comprising:

a tray molded integrally with at least one hook, the tray spaced apart from the bassinet bottom.

7. The foldable bassinet of claim 1, in which the hooks each comprise a finger release tab.

8. The foldable bassinet of claim 1, in which the bassinet bottom comprises a flexible sheet extending upwardly on opposite sides of the bottom to at least partially form a pair of flexible bassinet side walls.

9. A foldable bassinet and playard combination comprising:

a collapsible playard comprising;

a playard bottom having a length and a width, a first pair of playard side walls each having top and bottom edges and each side wall bottom edge of the first pair being attached along the width of the playard bottom, a second pair of playard side walls each having top and bottom edges and each side wall bottom edge of the second pair being attached along the length of the playard bottom, and a collapsible top rail attached to the top edges of the first and second pairs of playard side walls, the playard side walls and bottom forming a pocket in which an infant can play and into which a bassinet can be inserted; and a frameless and collapsible bassinet for attachment to the top rail of the playard and collapsible and foldable therewith, the bassinet comprising;

a bassinet floor having a length and a width, and collapsible along a fold line, a first pair of flexible bassinet side walls each having top and bottom edges and each side wall bottom edge of the first pair being attached along the width of the bassinet floor, a second pair of flexible bassinet side walls each having top and bottom edges and each sidewall bottom edge of the second pair being attached along the length of the bassinet bottom, the bassinet bottom and bassinet side walls forming a pocket for receipt of an infant, the pocket being foldable, and a plurality of spaced, substantially rigid hooks attached to the top edges of the second pair of side walls and releasably engageable with the playard top rail to form a frameless, foldable bassinet that is collapsible and foldable with the playard.

10. The foldable bassinet and playard combination of claim 9 in which the bassinet bottom comprises:

a first rigid bottom panel having an edge; and a second rigid bottom panel having an edge adjacent to the first panel edge to define the fold line along which the bassinet is collapsible.

11. The foldable bassinet and playard of claim 9, in which the bassinet bottom further comprises:

a fabric floor joined to the bassinet side walls;

a first rigid panel supported on the fabric floor, and having an edge;

a second rigid panel supported on the fabric floor, and having an edge adjacent to the first panel edge to define the fold line along which the bassinet bottom is collapsible;

a first foam sleeper pad supported on the first rigid panel, and having an edge substantially vertically aligned with the fold line;

a second foam sleeper pad supported on the second rigid panel, and having an edge adjacent to the first foam pad edge and substantially vertically aligned with the fold line; and a flexible fabric cover bearing on the first and second foam pads.

12. The foldable bassinet and playard of claim 11 in which two of the bassinet side panels and the bassinet fabric floor are all formed at least partly by a single continuous flexible fabric sheet.

13. The foldable bassinet and playard of claim 9 and further comprising:

an accessory tray attached to the bassinet.

14. The foldable bassinet and playard of claim 9, in which at least one of the clips comprises:

an accessory tray spaced apart from the bassinet floor.

15. The bassinet of claim 9 in which the clips include outwardly extending finger release tabs.

16. A bassinet for attachment to a top rail of a playard, the bassinet comprising:

a bottom having a perimeter, a first rigid bottom panel having an edge and a second rigid bottom panel having an edge adjacent to the first panel edge to define a line along which the bassinet bottom is collapsible;

a flexible side wall having a bottom edge attached to at least a portion of the perimeter of the bassinet bottom, and a frameless and sleeveless top edge;

the bassinet bottom and side wall forming a pocket for receipt of an infant; and a plurality of spaced, substantially rigid hooks attached to the top edge of the side wall, the hooks being adapted to removably receive the top rail of the playard.

17. The bassinet of claim 16 wherein the side wall comprises:

a plurality of side wall panels.

18. The bassinet of claim 16 wherein the side wall comprises:

a first pair of flexible side panels attached along a first pair of opposing sides of the bottom perimeter; and a second pair of flexible side wall panels attached along a second pair of opposing sides of the bottom perimeter.

19. The bassinet of claim 16, and further comprising:

a first flexible sleeper pad bearing on the first rigid panel, and having an edge substantially vertically aligned with the fold line; and a second flexible sleeper pad bearing on the second rigid panel and having an edge substantially vertically aligned with the fold line.

20. The bassinet of claim 19, and further comprising:

a flexible fabric top layer secured over the first and second sleeper pads.

21. The bassinet of claim 16, in which the hooks each comprise a finger release tab.

22. The bassinet of claim 16, in which the bassinet bottom comprises a flexible sheet extending upwardly on opposite sides of the bottom to at least partially form a pair of flexible bassinet side walls.

23. A bassinet for attachment to a top rail of a playard, the bassinet comprising:

a bottom having a perimeter;

a flexible side wall having a bottom edge attached to at least a portion of the perimeter of the bassinet bottom, and a frameless and sleeveless top edge;

the bassinet bottom and side wall forming a pocket for receipt of an infant;

a plurality of spaced, substantially rigid hooks attached to the top edge of the side wall, the hooks being adapted to removably receive the top rail of the playard; and a tray attached to the bassinet.

24. A bassinet for attachment to a top rail of a playard, the bassinet comprising:

a bottom having a perimeter;

a flexible side wall having a bottom edge attached to at least a portion of the perimeter of the bassinet bottom, and a frameless and sleeveless top edge;

the bassinet bottom and side wall forming a pocket for receipt of an infant;

a plurality of spaced, substantially rigid hooks attached to the top edge of the side wall, the hooks being adapted to removably receive the top rail of the playard; and a tray molded integrally with at least one hook, the tray spaced apart from the bassinet bottom.

* * * * *